US007852289B2

(12) United States Patent
Arai et al.

(10) Patent No.: US 7,852,289 B2
(45) Date of Patent: Dec. 14, 2010

(54) PLASMA DISPLAY PANEL DRIVING CIRCUIT AND PLASMA DISPLAY APPARATUS

(75) Inventors: Yasuhiro Arai, Osaka (JP); Manabu Inoue, Kyoto (JP); Toshikazu Nagaki, Osaka (JP)

(73) Assignee: Panasonic Corporation, Osaka (JP)

( * ) Notice: Subject to any disclaimer, the term of this patent is extended or adjusted under 35 U.S.C. 154(b) by 770 days.

(21) Appl. No.: 11/748,139

(22) Filed: May 14, 2007

(65) Prior Publication Data

US 2007/0268216 A1 Nov. 22, 2007

(30) Foreign Application Priority Data

May 16, 2006 (JP) ..... 2006-136499

(51) Int. Cl.
*G09G 3/28* (2006.01)

(52) U.S. Cl. ..... 345/60; 345/66

(58) Field of Classification Search ..... 345/60–72, 345/204, 211–214; 315/169.1, 169.4
See application file for complete search history.

(56) References Cited

U.S. PATENT DOCUMENTS 4,866,349 A 9/1989 Weber et al.
6,633,285 B1 * 10/2003 Kigo et al. ..... 345/204
7,209,099 B2 * 4/2007 Roh et al. ..... 345/60
7,274,343 B2 * 9/2007 Kim et al. ..... 345/62
2003/0057854 A1 * 3/2003 Roh ..... 315/169.3
2005/0110425 A1 * 5/2005 Lee ..... 315/169.4
2005/0116886 A1 * 6/2005 Jeong et al. ..... 345/60
2006/0038750 A1 * 2/2006 Inoue et al. ..... 345/60
2007/0115219 A1 5/2007 Inoue

FOREIGN PATENT DOCUMENTS

JP 7-109542 11/1995
JP 3369535 11/2002

OTHER PUBLICATIONS

English Language Abstract of EP 0 261 584, dated Mar. 30, 1988.
English Language Abstract of JP 3369535, dated Nov. 15, 2002.

* cited by examiner

*Primary Examiner*—Amare Mengistu
*Assistant Examiner*—Hong Zhou
(74) *Attorney, Agent, or Firm*—Greenblum & Bernstein, P.L.C.

(57) ABSTRACT

A PDP driving circuit is comprised of a power recovery unit for recovering an electric power from a capacitive load by resonance operation with PDP which is the capacitive load Cp, and reusing the recovered power. The power recovery unit includes a recovery inductor for resonating with the capacitive load, a recovery switch element for connecting the recovery capacitor to the capacitive load and recovery inductor, and forming a channel for passing resonance current, a counterflow preventive diode for blocking flow of current in the recovery switch element in reverse polarity direction, and a protective diode for forming a closed current channel including the recovery inductor and recovery switch element when the counterflow preventive diode is changed from ON state to OFF state.

14 Claims, 14 Drawing Sheets

6
50b
Vsus
V5
D51
D31
S7
Q31
L11
L12
Q41
S8
D61
D41
Cr2
10
Cp
501
Vscn
V4
D31
S31
C31
S32
IC31
SCAN IC
53
52
Vset
V2
S21
S22
Vad
V3
X
S10
S9
5101
50
Vsus
V1
D5
Q1
L1
L2
Q2
D6
D3
Q3
Q4
D4
Cr

PLASMA DISPLAY PANEL DRIVING CIRCUIT AND PLASMA DISPLAY APPARATUS

BACKGROUND OF THE INVENTION

1. Field of the Invention

The present invention relates to a plasma display panel driving circuit, as well as plasma display apparatus, used for wall-mounted television sets and large-screen monitors.

2. Related Art

An alternating-current surface discharge type plasma display panel (hereinafter called "PDP") as a typical AC type is constituted by arranging a front plate containing a glass substrate formed by disposing a scan electrode and a sustain electrode which carry out surface discharge and a back plate containing a glass substrate formed by disposing data electrodes oppositely in parallel so that both electrodes set up a matrix and that a discharge space is formed in a gap, and by sealing the perimeter portion with sealing materials such as glass frit. Between both substrates of the front plate and the back plate, discharge cells divided by bulkheads area provided, and in a cell space between these bulkheads, a phosphor layer is formed. In the PDP of such configuration, ultraviolet rays are generated by gas discharge, and with these ultraviolet rays, phosphors of red (R), green (G), and blue (B) colors are excited to emit light, thereby achieving a color display.

In such plasma display apparatus, various techniques are proposed for saving the power consumption.

For example, a so-called electric power recovery circuit is proposed, that is, in consideration that the PDP is a capacitive load, an inductor is included in component elements of a resonance circuit, and the inductor and the capacity load of the PDP are resonated in LC, the electric power accumulated in the capacity load of the PDP is recovered in a capacitor for power recovery, and the recovered power is reused for driving the PDP (see, for example, patent document 1).

In this technique, the electric power recovered from the PDP can be reused in sustain pulse voltage to scanning electrode and sustain electrode in sustain period, and the power consumed in sustain period is saved, so that the power consumption can be reduced.

That is, in the sustain period generating circuit, a resonance circuit having an inductor, or an electric power recovery circuit is installed. The electric power accumulated in the capacitive load of the PDP (the capacitive load generated in the scanning electrode) is recovered, and the recovered electric power is reused as driving power of scanning electrode, and the power consumption is saved. In the sustain pulse generating circuit, a power recovery circuit is provided. Hence, the electric power accumulated in the capacitive load of the PDP (capacitive load generated in the sustain electrode) is recovered, and the recovered power is reused as driving power of sustain electrode, and the power consumption is saved.

The power recovery circuit recovers and supplies electric power by LC resonance between the capacity load of PDP and recovery inductor by using the recovery inductor of inductance element. When recovering the electric power, the electric power accumulated in the capacitive load generated in the scanning electrode is moved to the recovery capacitor by way of a counterflow preventive diode and a switching element. When supplying the electric power, the electric power accumulated in the recovery capacitor is supplied to the PDP by way of the counterflow preventive diode and switching element. Thus, the scanning electrode of PDP is driven in sustain period. Therefore, in the power recovery circuit, without supply of electric power from the power source in sustain period, the scanning electrode is driven by LC resonance, so that the power consumption is theoretically zero.

The above operation of recovery circuit is assumed without consideration of parasitic components of diode or wiring. To be precise, operation of recovery circuit is influenced by various parasitic components, such as parasitic capacity component parallel between drain terminal and source terminal of switching element, or anode terminal and cathode terminal of diode element, and parasitic inductance component in series to the pattern portion wiring between elements.

Effects of such parasitic components are serious problems when the diode element is switched from ON to OFF state. In recovery operation, the resonance current flows, but when the counterflow preventive diode is changed from ON to OFF, a reverse current due to parasitic capacity of diode flows (which is called recovery current).

By this recovery current, energy is accumulated in the recovery inductor, and when the counterflow preventive diode is completely turned off, the product of inductance value of recovery inductor and time change value of recovery current becomes a surge voltage, which is generated in the recovery inductor terminal.

This surge voltage is applied to the counterflow preventive diode, and the withstand voltage of the counterflow preventive diode is required to have a sufficient allowance more than the surge voltage as compared with the actual working voltage.

To solve this problem, it is proposed to use a protective diode element in the recovery circuit (see, for example, patent document 2). FIG. 14 shows its configuration. In the diagram, the recovery circuit includes recovery capacitor Cr, recovery switches Q3, Q4, counterflow preventive diodes D3, D4, recovery inductors L1, L2, and protective diodes D105, D106. Switching elements Q1, Q2 constitute a sustain circuit for supplying sustain voltage Vsus. To simplify the explanation, in FIG. 14, only the portion relating to recovery operation is described out of the configuration of scan circuit and sustain circuit. FIG. 14 is a circuit diagram for explaining the operation when the sustain circuit is grounded.

At the time of generating a surge voltage in the counterflow preventive diode D3, the protective diode D105 conducts, and the energy accumulated in the inductor L1 is consumed in the channel of inductor L1 to protective diode D105 to switching element Q1, and thereby generation of surge is suppressed.

Similarly at the time of generating a surge voltage in the counterflow preventive diode D4, the protective diode D106 conducts, and the energy accumulated in the inductor L2 is consumed in the channel of inductor L2 to switching element Q2 to protective diode D106, and thereby generation of surge is suppressed.

Patent document 1: Japanese Patent Publication No. 7-109542

Patent document 2: Japanese Patent No. 3369535

The above explanation refers to an operation not in consideration of parasitic inductance component of wiring. Actually, as shown in FIG. 14, parasitic inductance components L3 to L6 present in the wiring between recovery switches Q3, Q4 and counterflow preventive diodes D3, D4. In the conventional circuit, therefore, surge absorbing effect is not obtained in parasitic inductance components (L3 to L6).

Actually, due to effects of parasitic inductance components, a surge voltage is generated between terminals of counterflow preventive diode, and the required withstand voltage for counterflow preventive diode is raised. Elevation of withstand voltage between terminals leads to increase of semiconductor element loss of recovery circuit such as increase of forward voltage drop and decline of switching speed. To reduce the parasitic inductance, it is desired to increase the thickness and shorten the distance of wiring pattern.

In configuration of semiconductor elements, there are various limits from the aspects of substrate area, heat releasing efficiency of cooling plates for fixing semiconductor elements, and others, and it is practically next to impossible to design thick and short wiring pattern while satisfying these limits, and it has been difficult to keep the parasitic inductance always at low level.

In the prior art, as described herein, a higher withstand voltage is required in the semiconductor elements of recovery circuit when driving the PDP, and the loss of semiconductor elements is increased, and hence the recovery efficiency drops. Moreover, since the loss of semiconductor elements is increased, a plurality of semiconductor elements must be connected in parallel, which causes to increase the cost and increase the mounting area.

The invention is devised in the light of these problems, and it is hence an object thereof to present a PDP driving circuit capable of reducing the mounting area and enhancing the recovery efficiency by lowering the withstand voltage of the counterflow preventive diodes and protective diodes in the power recovery circuit, and thereby curtaining the number of component elements, and a plasma display apparatus using the same.

SUMMARY OF THE INVENTION

A first aspect of the invention provides a driving circuit for driving a plasma display panel which is a capacitive load. The driving circuit includes a pulse generation unit for generating a specified pulse voltage and applying to the capacitive load, and a power recovery unit for recovering an electric power from the capacitive load by resonant operation with capacitive load, and supplying the recovered power to a capacitive load. The power recovery unit has a larger capacity than the capacitive load, and includes a recovery capacitor for accumulating the recovered power, a recovery inductor for resonating with the capacitive load, a recovery switch element for forming a channel of passing current accompanied by resonance of capacitive load and recovery inductor by connecting the recovery capacitor to the capacitive load and recovery inductor, a counterflow preventive diode for blocking the current flowing in the recovery switching element in reverse polarity direction, and a protective diode. The protective diode forms a closed current channel including recovery inductor and recovery switch element when the counterflow preventive diode element is changed from ON to OFF state.

A second aspect of the invention provides a plasma display apparatus. The plasma display apparatus includes a plasma display panel having a plurality of scan electrodes and sustain electrodes, and the specified driving circuit for driving the plasma display panel.

According to the invention, in the power recovery circuit, when the counterflow preventive diode element is switched from ON state to OFF state by the protective diode, a closed current channel including recovery inductor and recovery switch element is formed, and the voltage applied to the protective diode is reduced, and the withstand voltage of the protective diode can be lowered. As a result, loss of protective diode is decreased, the number of elements connected in parallel can be reduced, and the mounting area can be decreased.

Further, the invention also suppresses the surge voltage generated when the counterflow preventive diode is changed from ON state to OFF state, and the withstand voltage of counterflow preventive diode can be lowered, and normal bias voltage drop Vf of counterflow preventive diode is lowered, and the recovery rate of electric power accumulated in the capacitive load of plasma display panel is improved, and the power consumption can be saved.

DETAILED DESCRIPTION OF THE PREFERRED EMBODIMENTS

A preferred embodiment of the invention is described specifically below by referring to the accompanying drawings.

1. PDP Driving Circuit

Figure 1:
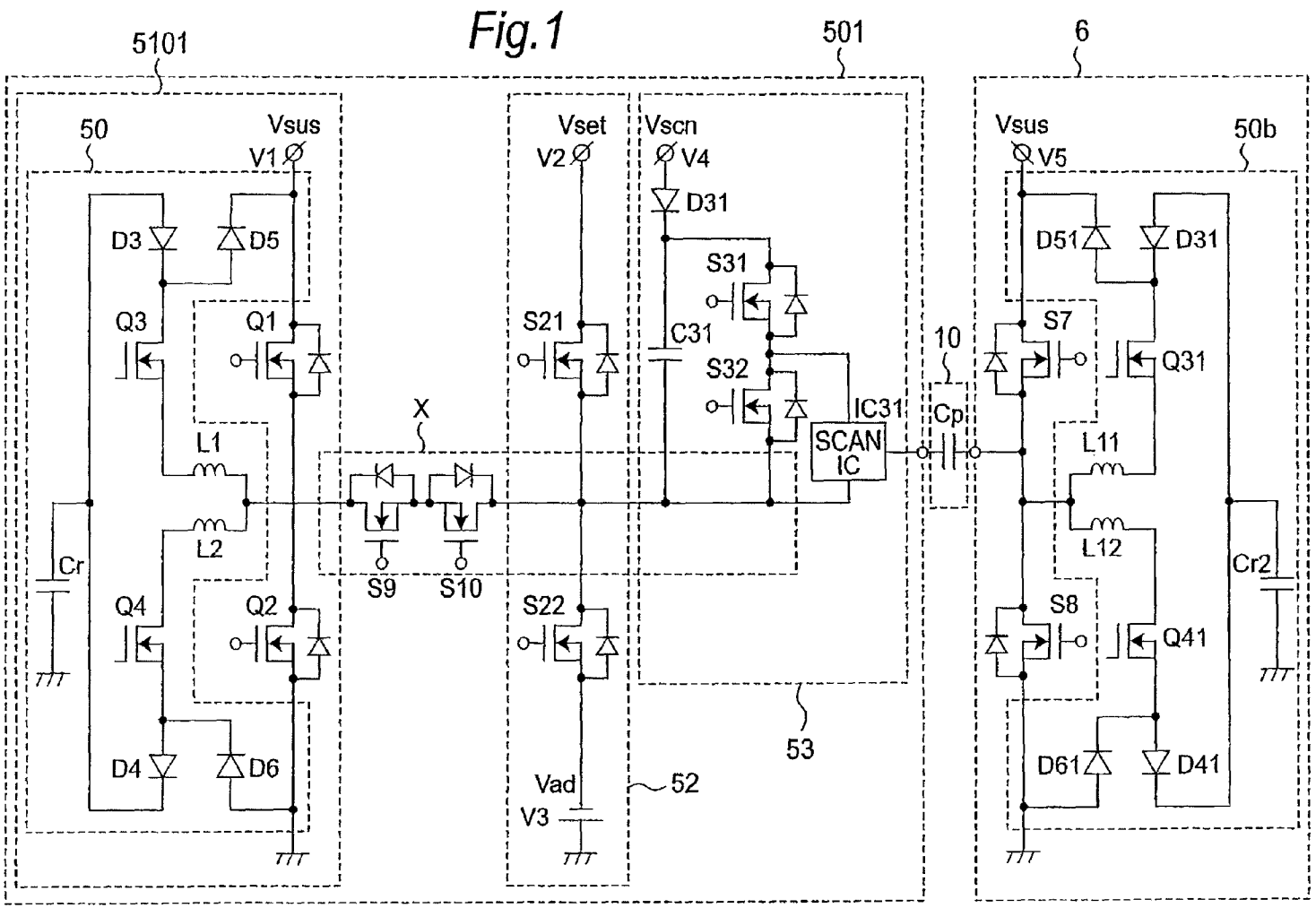
FIG. 1 is an illustration of PDP driving circuit configuration in an embodiment of the invention.

FIG. 1 is a block diagram of PDP driving circuit in an embodiment of the invention. The PDP driving circuit shown in FIG. 1 is a circuit for applying a drive voltage to electrodes of a plasma display panel (PDP), and driving the PDP. Prior to specific description of configuration and operation of PDP driving circuit, the configuration and operation of PDP are explained below. In FIG. 1, the PDP 10 is shown as a capacitive addition Cp.

1.1 Plasma Display Panel (PDP)

Figure 2:
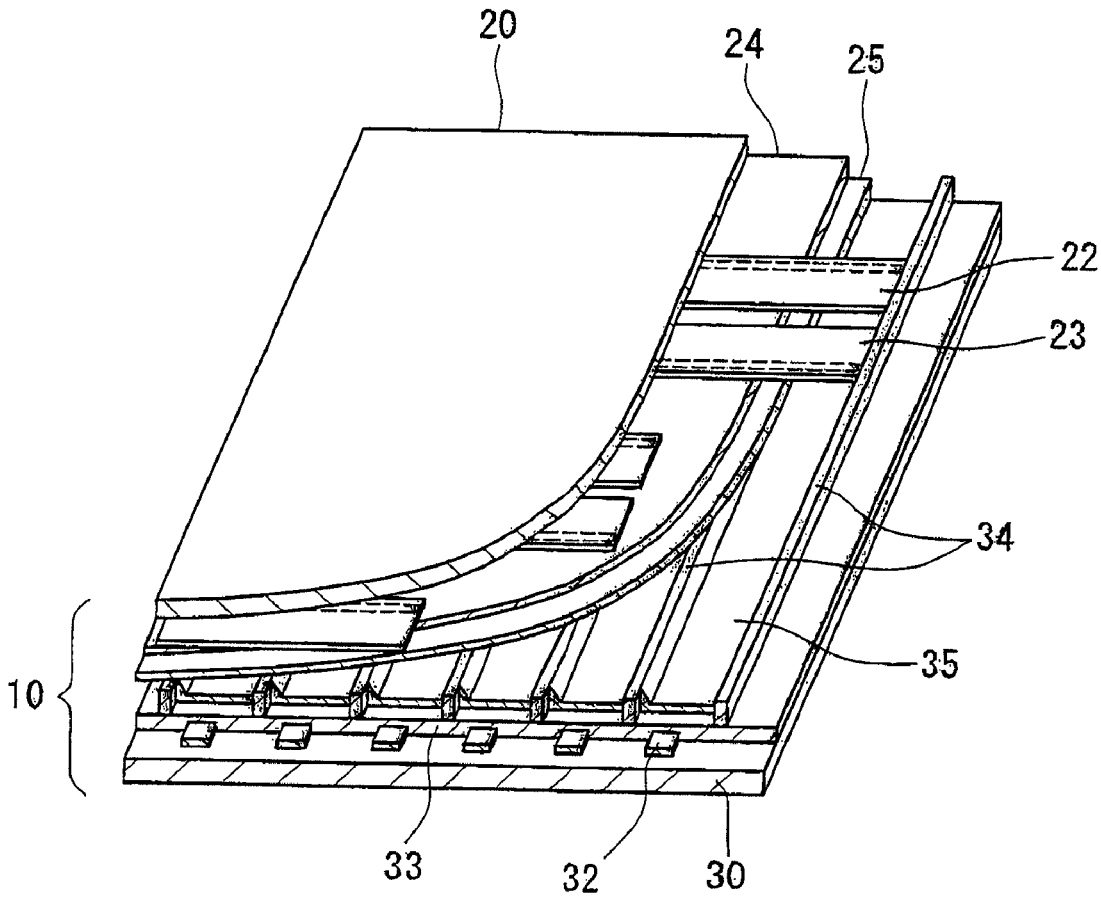
FIG. 2 is a perspective view of configuration of plasma display panel (PDP).

FIG. 2 is a perspective view that indicates a structure of plasma display panel (PDP) driven by the PDP driving circuit of the embodiment. On a glass front plate 20 which is a first substrate, a plurality of display electrodes are formed in a pair of stripe scan electrode 22 and stripe sustain electrode 23. To cover the scan electrode 22 and sustain electrode 23, a dielectric layer 24 is formed, and a protective layer 25 is formed on the dielectric layer 24.

On a back plate 30 which is a second substrate, a plurality of stripe data electrodes 32 covered with a dielectric layer 33 are formed so as to make overhead crossing with scan electrodes 22 and sustain electrodes 23. A plurality of bulkheads 34 are disposed parallel to the data electrodes 32 on the dielectric layer 33, and a phosphor layer 35 is formed on the dielectric layer 33 between these bulkheads 34. The data electrodes 32 are disposed at positions between adjacent bulkheads 34.

The front plate 20 and back plate 30 are disposed facing each other across a microscopic discharge space so that the scan electrodes 22 and sustain electrodes 23 may be orthogonal to the data electrodes 32, and the perimeter portion is sealed with a sealing material such as glass frit. The discharge space is packed with a mixed gas of, for example, neon (Ne) and xenon (Xe) as discharge gas. The discharge space is partitioned into a plurality of compartments by the bulkheads 34, and phosphor layers 35 emitting light of each color of red (R), green (G), and blue (B) are sequentially disposed in each compartment. Discharge cells are formed at portions where scan electrodes 22 and sustain electrode 23 intersect with data electrodes 32, and one pixel is composed of three adjacent discharge cells forming phosphor layers 35 emitting light of each color. A region forming the discharge cells composing the pixel is an image display region, and a surrounding area of image display region is a non-display region not displaying image such as glass frit region.

Figure 3:
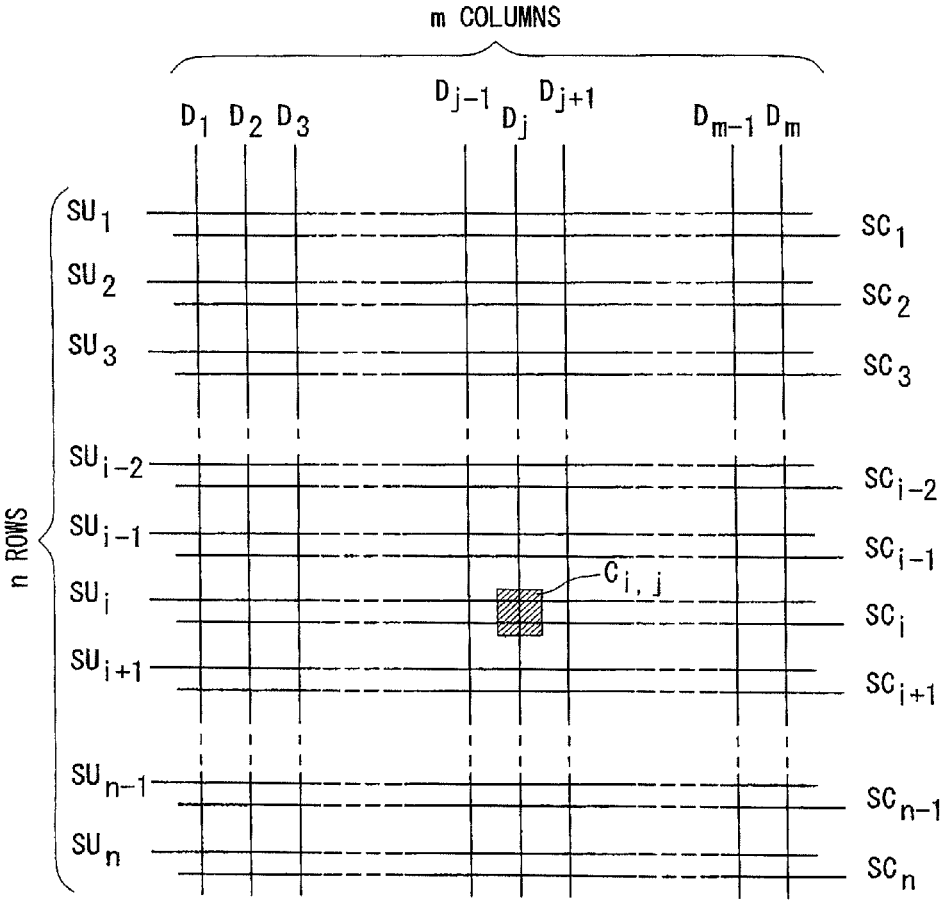
FIG. 3 is an electrode configuration of PDP.

FIG. 3 shows an electrode configuration in the PDP 10. In the row direction, n rows of scan electrodes SC1 to SCn (scan electrodes 22 in FIG. 2) and n rows of sustain electrodes SU1 to SUn (sustain electrodes 23 in FIG. 2) are arrayed alternately, and in the column direction, m columns of data electrodes D1 to Dm (data electrodes 32 in FIG. 2) are arrayed. Discharge cells Ci,j including a pair of scan electrode SCi and sustain electrode SUi (i=1 to n), and one data electrode Dj (j=1 to m) are formed in the discharge space. The total number of discharge cells C is (m×n) pieces.

In the PDP 10 having such configuration, an ultraviolet ray is generated by gas discharge, and phosphors of each color of R, G, and B are excited by the ultraviolet ray, and light is emitted, thereby a color display is produced. The PDP 10 displays in gradation by dividing one field period into a plurality of subfields, combining subfields of colors and driving. Each subfield is composed of reset period, address period, and sustain period. To display image data, a signal waveforms that varies in accord with reset period, address period, and sustain period, respectively, is applied to each electrode.

1.1.1 Drive Voltage Waveform of PDP

Figure 4:
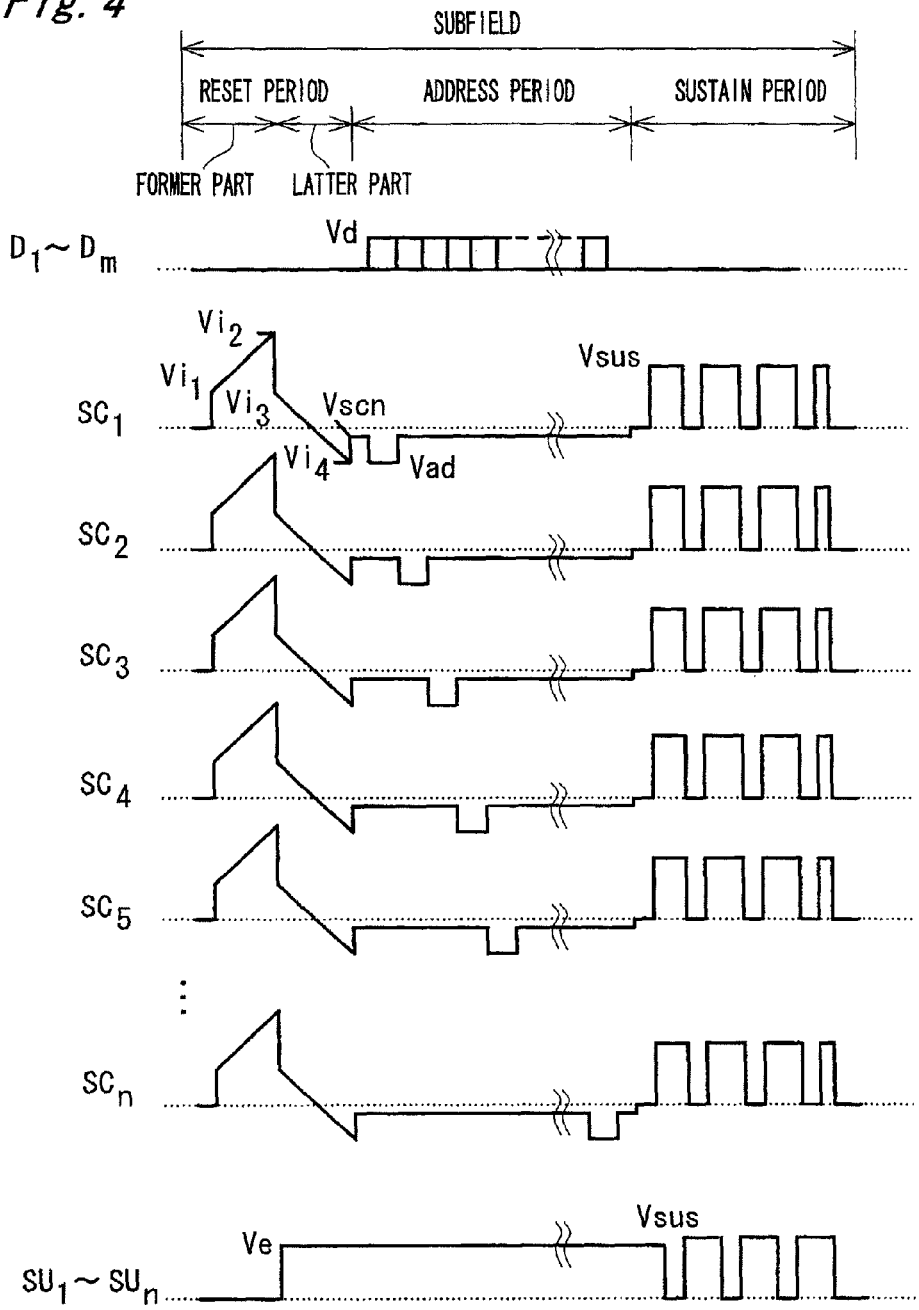
FIG. 4 is a diagram of drive voltage waveform applied to each electrode of PDP.

FIG. 4 shows each drive voltage waveform to be applied to each electrode of the PDP 10. As shown in FIG. 4, each subfield has reset period, address period, and sustain period. Each subfield operates almost similarly except that the number of sustain pulses in the sustain period is different in order to vary the weight in light emission period, and the principle of operation is nearly the same in the subfields, and operation of only one subfield is explained below.

First, in the reset period, for example, a positive pulse voltage is applied to all scan electrodes SC1 to SCn, and a necessary wall charge is accumulated on the protective layer 25 and phosphor layer 35 on the dielectric layer 24 covering the scan electrodes SC1 to SCn and sustain electrodes SU1 to SUn. In this reset period, priming (detonator for discharge=exciting particle) is generated in order to decrease discharge delay and generate address discharge stably.

Specifically, in first half of reset period, the data electrodes D1 to Dm, and sustain electrodes SU1 to SUn are held at 0 (V), and in scan electrodes SC1 to SCn, a slant waveform voltage ascending slowly from voltage Vi1 below discharge start voltage toward voltage V12 exceeding discharge start voltage is applied to data electrodes D1 to Dm. In the ascending process of slant waveform voltage, a first feeble reset discharge occurs between scan electrodes SC1 to SCn and sustain electrodes SU1 to SUn, and data electrodes D1 to Dm. Negative wall voltages are accumulated in the upper parts of scan electrodes SC1 to SCn, and positive wall voltages are accumulated in the upper parts of data electrodes D1 to Dm and upper parts of sustain electrodes SU1 to SUn. Herein, the wall voltages in the upper parts of electrodes refer to voltages generated by wall charges accumulated on the dielectric layer covering the electrodes.

In latter half of reset period, sustain electrodes SU1 to SUn are held at positive voltage Ve, and in scan electrodes SC1 to SCn, a slant waveform voltage descending slowly from voltage V13 below discharge start voltage toward voltage V14 exceeding discharge start voltage is applied to sustain electrodes SU1 to SUn. In this process, a second feeble reset discharge occurs between scan electrodes SC1 to SCn and sustain electrodes SU1 to SUn, and data electrodes D1 to Dm. Negative wall voltages in the upper parts of scan electrodes SC1 to SCn, and positive wall voltages in the upper parts of sustain electrodes SU1 to SUn are weakened, and the positive wall voltages in the upper parts of data electrodes D1 to Dm are adjusted to values suited to address operation. As a result, reset operation is terminated (hereinafter, the drive voltage waveform applied to each electrode in the reset period is called the "reset waveform.").

Consequently, in address period, scanning is performed by applying negative scanning pulses sequentially to all scan electrodes SC1 to SCn. While scanning the scan electrodes SC1 to Scn, positive write pulse voltages are applied to data electrodes D1 to Dm on the basis of display data. Thus, address discharge occurs between scan electrodes SC1 to SCn and data electrodes D1 to Dm, and a wall charge is formed on the surface of protective layer 25 on the scan electrodes SC1 to SCn.

Specifically, in address period, the scan electrodes SC1 to SCn are once held at voltage Vscn. Next, in address operation of discharge cells Cp,1 to Cp,m (p being an integer of 1 to n), scan pulse voltage Vad is applied to scan electrode SCp, and positive address pulse voltage Vd is applied to data electrode Dq (Dq being a data electrode selected on the basis of video signal out of D1 to Dm) corresponding to video signal to be displayed on the p-th row of data electrodes D1 to Dm. Thus, address discharge occurs at discharge cells Cp,q corresponding to the intersection of data electrode Dq provided with address pulse voltage and scan electrode SCp provided with scan pulse voltage. By this address discharge, positive voltages are accumulated in the upper part of scan electrode CSp of discharge cells Cp,q, and negative voltages are accumulated in the upper part of the sustain electrode SUp, and the address operation is terminated. Hereinafter, similar address operation is executed up to the discharge cells Cn,q on the n-th row, and the address operation is completed.

In successive sustain period, for a specific period, a sufficient voltage for sustaining discharge is applied between scan electrodes SC1 to SCn and sustain electrodes SU1 to SUn. As a result, a discharge plasma is generated between scan electrodes SC1 to SCn and sustain electrodes SU1 to SUn, and the phosphor layer is excited and illuminated for a specific period. At this time, in the discharge space not provided with address pulse voltage in address period, discharge does not occur, and the phosphor layer 35 is not excited or illuminated.

Specifically, in sustain period, the scan electrodes SC1 to SCn are once returned to 0 (V), and then the sustain electrodes SU1 to SUn are returned to 0 (V) Consequently, positive sustain pulse voltage Vsus is applied to scan electrodes SC1 to SCn. At this time, the voltage between upper part of scan electrode SCp and upper part of sustain electrode SUp in the discharge cells Cp,q causing address discharge is provided with wall voltages accumulated in the upper part of scan electrode SCp and upper part of sustain electrode SUp in address period, in addition to positive sustain pulse voltage Vsus, and hence becomes larger than discharge start voltage, and a first sustain discharge is generated. In the discharge cells Cp,q causing sustain discharge, negative voltages are accumulated in the upper part of scan electrode SCp so as to cancel the potential difference of scan electrode SCp and sustain electrode SUp upon generation of sustain discharge, while positive voltages are accumulated in the upper part of sustain electrode SUp. In this way, the first sustain discharge is terminated. After first sustain discharge, scan electrodes SC1 to SCn are once returned to 0 (V), and then Vsus is applied to sustain electrodes SU1 to SUn. At this time, the voltage between upper part of scan electrode SCp and upper part of sustain electrode Sup in the discharge cells Cp,q causing first sustain discharge is provided with wall voltages accumulated in the upper part of scan electrode SCp and upper part of sustain electrode SUp in first sustain discharge, in addition to positive sustain pulse voltage Vsus, and hence becomes larger than discharge start voltage, and a second sustain discharge is generated. Similarly, thereafter, sustain pulses are alternately applied to scan electrodes SC1 to SCn and sustain electrodes SU1 to SUn, and sustain discharge is executed consecutively in the discharge cells Cp,q causing address discharge by the number of times of sustain pulse.

1.2 Scan Electrode Driving Circuit and Sustain Electrode Driving Circuit

Back to FIG. 1, the PDP driving circuit in the embodiment is provided with scan electrode driving circuit 501 and sustain electrode driving circuit 6.

1.2.1 Scan Electrode Driving Circuit

The scan electrode driving circuit 501 includes sustain pulse generating circuit 5101, reset waveform generating circuit 52, scan pulse generating circuit 53, and separation switches S9, S10.

(Sustain Pulse Generating Circuit)

The sustain pulse generating circuit 5101 has constant voltage power source V1 for issuing direct-current voltage Vsus, switching elements (sustain switches) Q1, Q2, and power recovery circuit 50. The sustain switches Q1, Q2 are composed of generally known elements for performing switching action such as MOSFET.

The power recovery circuit 50 has recovery inductors L1, L2, recovery capacitor Cr, switching elements (recovery switches) Q3, Q4, counterflow preventive diodes D3, D4, and protective diodes D5, D6. The sustain pulse generating circuit 5101 generates sustain pulses to be applied to scan electrodes SC1 to SCn by on/off operation of switching elements Q1, Q2, Q3, Q4.

One end of recovery capacitor Cr is connected to the ground. Between other end of recovery capacitor Cr, and connection point of sustain switch Q1 and sustain switch Q2, recovery capacitor Cr, counterflow preventive diode D3, recovery switch Q3, and recovery inductor L1 are connected in series. Between other end of recovery capacitor Cr, and connection point of switching element Q1 and switching element Q2, counterflow preventive diode D4, recovery switch Q4, and recovery inductor L2 are connected in series. The anode of protective diode D5 is connected to the connection point of counterflow preventive diode D3 and recovery switch Q3, and its cathode is connected to the constant voltage power source V1. The cathode of protective diode D6 is connected to the connection point of counterflow preventive diode D4 and recovery switch Q4, and its anode is connected to the ground.

The power recovery circuit 50 uses recovery inductors L1, L2 which are inductance elements, and recovers and reuses the electric power by LC resonance between capacity load of PDP (capacitive load generated in scan electrodes SC1 to SCn in FIG. 3) and inductance of recovery inductor L1 or L2.

The switching element Q1 supplies electric power to scan electrodes SC1 to SCn of the PDP 10 through switching elements S9 and S10 from the constant voltage power source V1, and clamps the scan electrodes SC1 to SCn at voltage value Vsus. The switching element Q2 clamps the scan electrodes SC1 to SCn at grounding potential by way of switching elements S9 and S10. By these operations, the scan electrodes SC1 to SCn are driven.

(Reset Waveform Generating Circuit)

The reset waveform generating circuit 52 includes switching elements S21, S22 composed of generally known elements for making switching action such as MOSFET, constant voltage power source V2 of voltage value Vset of second power source higher than the potential of the constant voltage power source V1, and constant voltage power source V3 of negative voltage value Vad of third power source. Electric power is supplied to scan electrodes SC1 to SCn from the constant voltage power source V2 through switching element S21, and electric power of negative potential is supplied to scan electrodes SC1 to SCn from constant voltage power source V3 through switching element S22, and thereby reset waveform is generated. The switching element S21 is disposed in a direction of cutting off the current of the body diode flowing in the main discharge channel from the constant voltage power source V2, and the switching element 322 is disposed in a direction of cutting off the current of the body diode flowing from the main discharge channel X to the constant voltage power source V3.

The reset waveform generating circuit 52 generates, in first half of reset period, voltage V12 exceeding discharge start voltage from voltage Vi1 below discharge start voltage to data electrodes D1 to Dm, that is, slant waveform ascending slowly toward Vset, and in second half of reset period, generates voltage V14 exceeding discharge start voltage from voltage V13 below discharge start voltage to sustain electrodes SU1 to SUn, that is, slant voltage slowly descending toward Vad, and applied to scan electrodes SC1 to SCn.

(Scan Pulse Generating Circuit)

The scan pulse generating circuit 53 includes switching elements S31, S32 composed of generally known elements for making switching action such as MOSFET, constant voltage power source V4 of voltage value Vscn, counterflow preventive diode D31 for preventing flow of current into the constant voltage power source V4, capacitor C31, and scan IC (IC31) for making switching action, and generates negative scan pulses in address period, and applies sequentially to scan electrodes SC1 to SCn. The scan IC (IC31) is a circuit for selecting among scan electrodes SC1 to SCn for applying voltage for address discharge.

These switching elements S1, S2, S5, S6, S21, S22, S31, S32, and scan IC (IC31) are changed over and controlled on the basis of subfield control signal generated in the subfield processing circuit 3.

1.2.2 Sustain Electrode Driving Circuit

The sustain electrode driving circuit 6 includes constant voltage power source V5 for issuing direct-current voltage Vsus, switching elements S7, S8 composed of generally known elements for making switching action such as MOSFET, and power recovery circuit 50*b*. The power recovery circuit 50*b* has recovery inductors L11, L12, recovery capacitor Cr2, switching elements Q31, Q41, counterflow preventive diodes D31, D41, and protective diodes D51, D61. Operation of sustain electrode driving circuit 6 is same as that of sustain pulse generating circuit 5101. The sustain electrode driving circuit 6 cooperates with the sustain pulse generating circuit 5101, and applies a specified voltage to the PDP 10.

1.2.3 Operation of Power Recovery Circuit

Operation of power recovery circuit 50 in the embodiment is explained while referring to FIG. 5 to FIG. 8.

Figure 5:
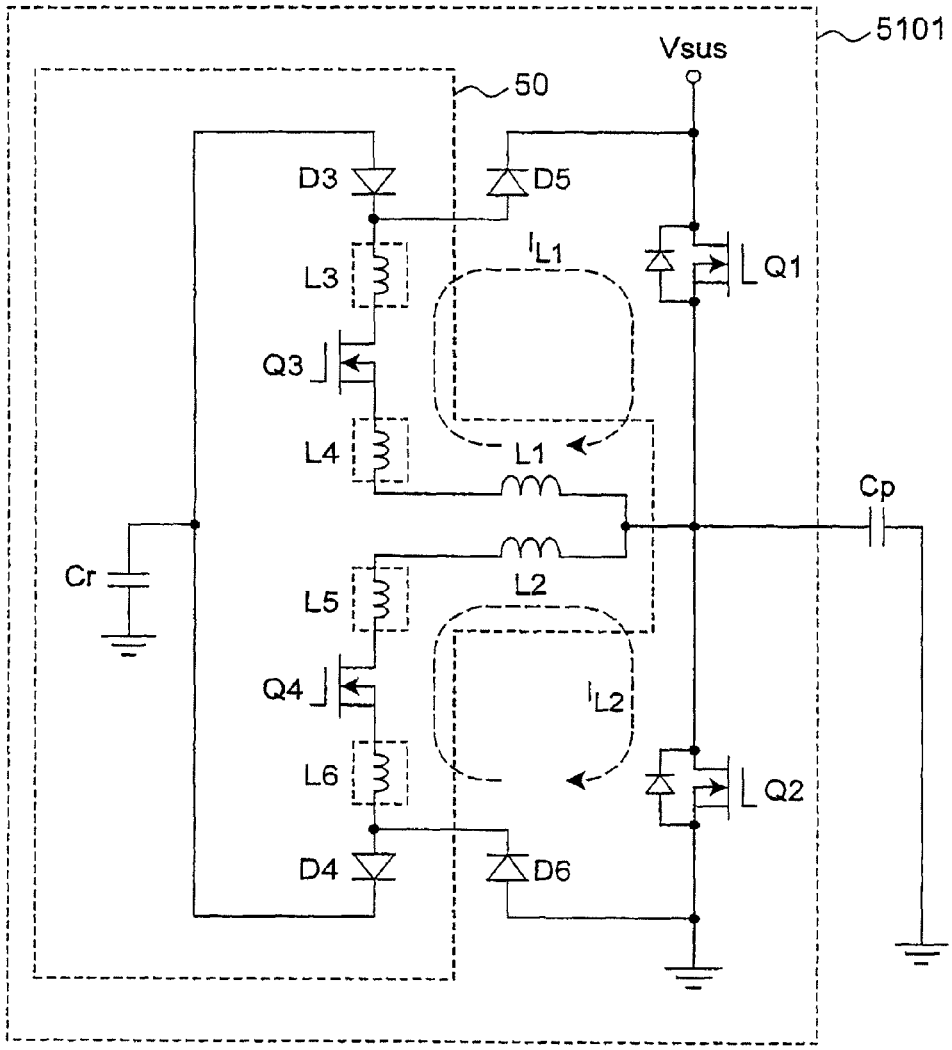
FIG. 5 is a diagram of parasitic inductance of wiring in PDP driving circuit.

FIG. 5 is a circuit diagram adding actually existing parasitic inductance components L3 to L6 of wiring to the electric power circuit 50 in FIG. 1. Parasitic inductance L3 shows the sum of parasitic inductance of wiring between counterflow preventive diode D3 and recovery switch Q3, and wiring between recovery switch Q3 and protective diode D5. Parasitic inductance L4 shows the parasitic inductance of wiring between recovery switch Q3 and recovery inductor L1. Parasitic inductance L5 shows the parasitic inductance of wiring between recovery inductor L2 and recovery switch Q4. Parasitic inductance L6 shows the sum of parasitic inductance of wiring between recovery switch Q4 and counterflow preventive diode D4, and wiring between recovery switch Q4 and protective diode D6.

Figure 6:
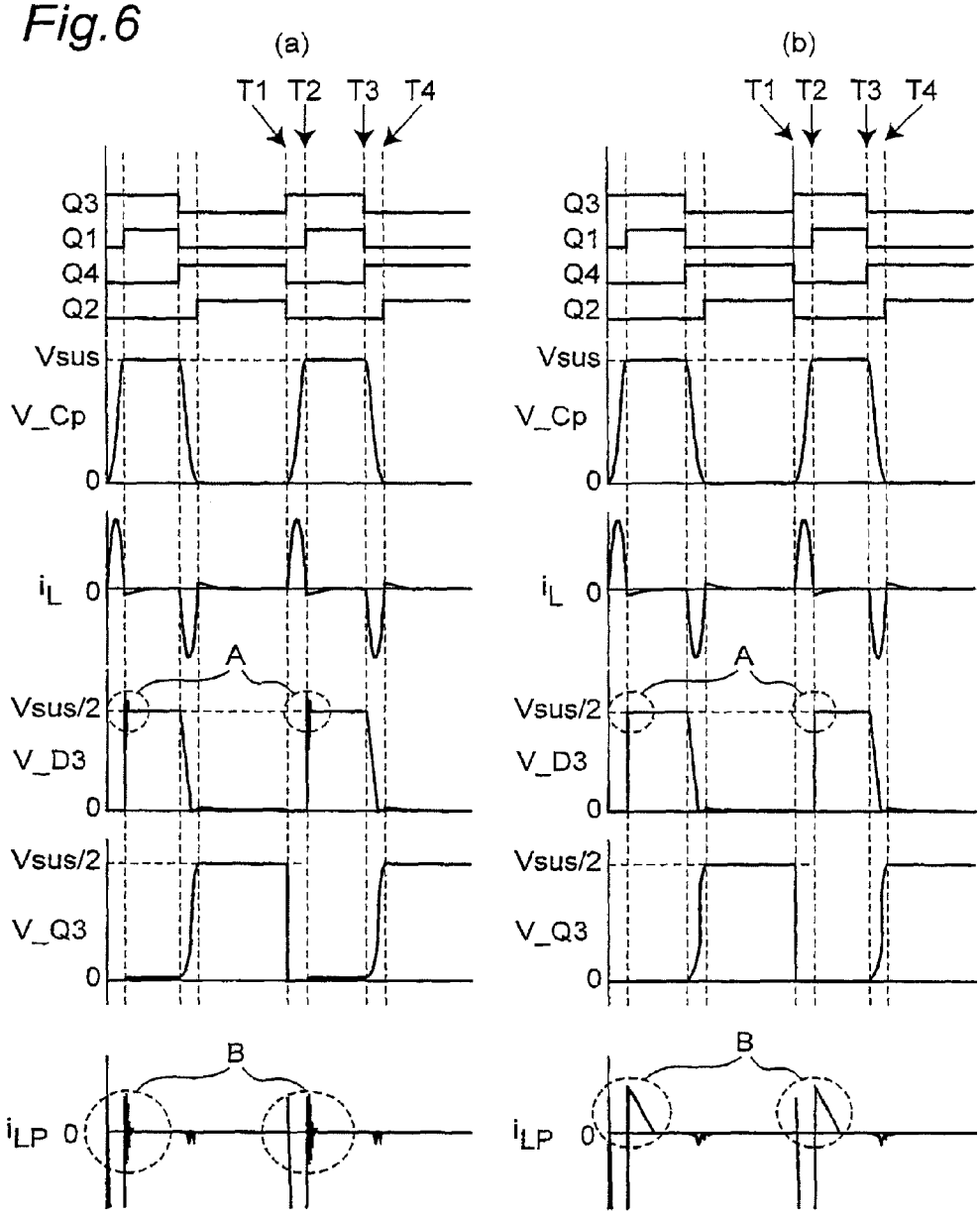
FIG. 6 is a comparative explanatory diagram of drive waveform and, voltage and current waveform of component elements of PDP driving circuit in an embodiment and PDP driving circuit in a prior art.
Figure 7:
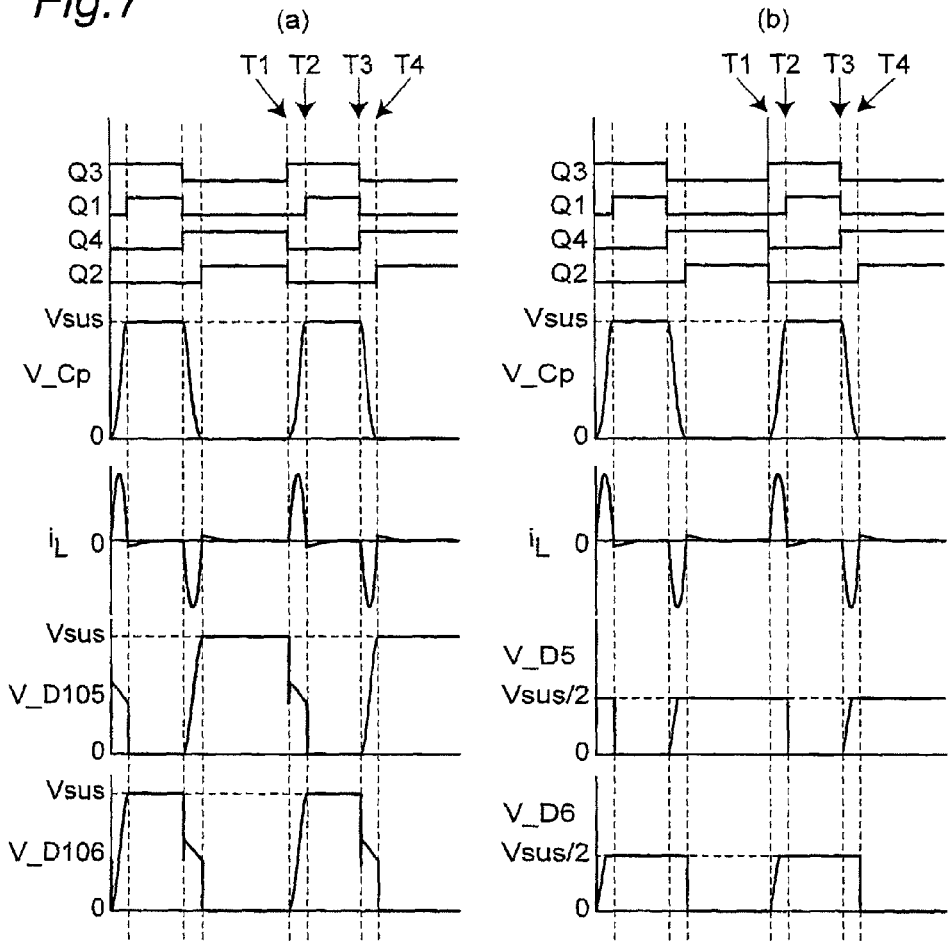
FIG. 7 is a comparative explanatory diagram of drive waveform and, voltage and current waveform of component elements of PDP driving circuit in an embodiment and PDP driving circuit in a prior art.
Figure 8:
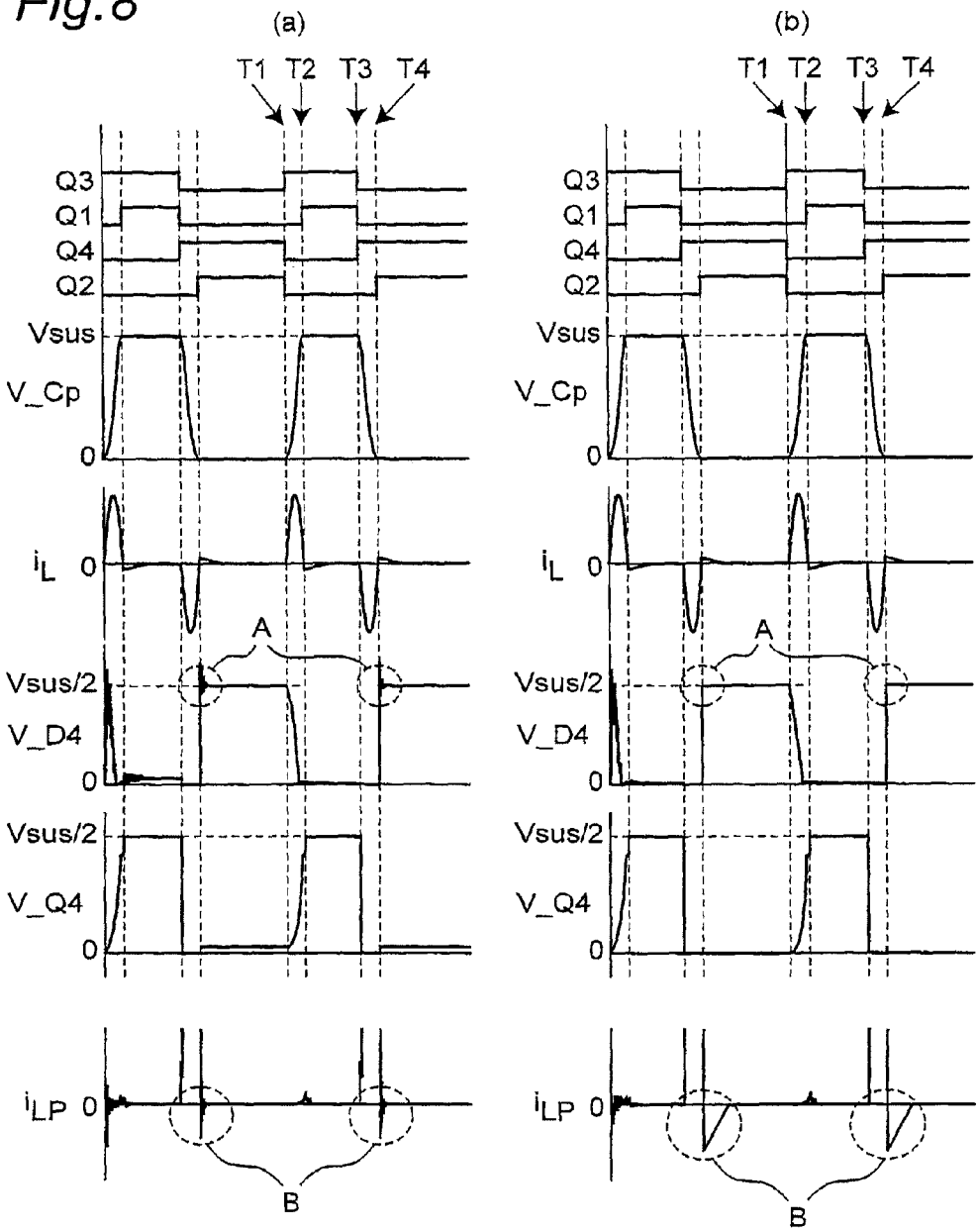
FIG. 8 is a comparative explanatory diagram of drive waveform and, voltage and current waveform of component elements of PDP driving circuit in an embodiment and PDP driving circuit in a prior art.

FIG. 6 to FIG. 8 show drive waveform of sustain pulse generating circuit 5101, and voltage waveform and current waveform of elements in power recovery circuit. FIG. 6 (*a*), FIG. 7 (*a*), and FIG. 8 (*a*) show waveforms corresponding to the conventional power recovery circuit shown in FIG. 12, and FIG. 6 (*b*), FIG. 7 (*b*), and FIG. 8 (*b*) show waveforms corresponding to the power recovery circuit of the embodiment shown in FIG. 1.

In FIG. 6 and FIG. 8, the waveforms represent, sequentially from the top, gate signal of recovery switch Q3, gate signal of sustain switch Q1, gate signal of recovery switch Q4, gate signal of sustain switch Q2, voltage V_Cp of PDP 10, sum iL of current (iL1) flowing in recovery inductor L1 and current (iL2) flowing in recovery inductor L2, voltage across counterflow preventive diode D3 (reverse bias is positive direction) V_D3, voltage across recovery switch Q3 V_Q3, and current iLP flowing in parasitic inductors L3, L4 (or L5, L6).

In FIG. 7 (*a*), V_D105 and V_D106 respectively show waveforms of voltages across protective diodes D105 and D106 in the prior art (reverse bias is positive direction). In FIG. 7 (*b*), V_D5 and V_D6 are respectively voltages across protective diodes D5 and D6 (reverse bias is positive direction).

Operation of power recovery circuit 50 in the embodiment in the modes of period T1 to T4 is explained below in comparison with the prior art.

<Mode 1>: Period from T1 to T2

Voltage V_Cp of PDP 10 is zero, the sustain switch Q2 is on, and is turned off at timing T1, and the recovery switch Q3 is turned on. As a result, capacity Cp of PDP 10 is charged from the recovery capacitor Cr in the channel of diode D3 to parasitic inductor L3 to recovery switch Q3 to parasitic inductor L4 and to recovery inductor L1. This flowing resonance current iL is inverted after a certain peak and becomes zero, and mode 1 is terminated at this timing (T2).

In this period, the voltage across terminals V_D106 of the conventional protective diode D106 is applied up to Vsus as shown in FIG. 8 (*a*), whereas the voltage across terminals V_D6 of the protective diode D6 of the embodiment is applied only to Vsus/2 as shown in FIG. 8 (*b*). This is because the connection point of the conventional protective diode D106 is the terminal of recovery inductor L2, whereas the connection point of the protective diode D6 of the invention is connected to the connection point of recovery switch Q4 and counterflow preventive diode D4.

That is, in this mode, the connection point potential of recovery inductor L2 and protective diode D106 in the prior art is Vsus, but the connection point potential of protective diode D6 of the embodiment is Vsus/2, lower by the portion of Vsus/2 of the voltage across terminals of recovery switch D4 than Vsus.

Therefore, the withstand voltage of the protective diode D6 of the embodiment can be reduced to half of the conventional protective diode D106. It is hence possible to use a protective diode element having a lower forward voltage drop Vf, and heat loss occurring in protective diode can be reduced. Besides, the cost of the protective diode element is lowered. When a plurality of diodes are connected in parallel, since the number of pieces of parallel connection can be decreased, and the substrate mounting area is smaller, the manufacturing cost can be reduced.

<Mode 2>: Period from T2 to T3

Voltage V_Cp of PDP 10 is charged nearly to Vsus, and the sustain switch Q1 is off, and is turned on at the timing T2. At this timing, voltage V_Cp of PDP 10 is fixed at Vsus, but resonance current iL inverted at point T2 charges the parasitic capacity (not shown) of the counterflow preventive diode D3, and turns off the counterflow preventive diode D3.

At this time, in the voltage waveform V_D3 across both ends of conventional counterflow preventive diode D3, a surge voltage (see broken line region A in FIG. 7 (*a*)) is generated. By contrast, in the voltage waveform V_D3 across both ends of the counterflow preventive diode D3 of the power recovery circuit 50 of the embodiment, surge voltage is suppressed (see broken line region A in FIG. 7 (*b*)). The reason is as follows why the surge voltage is suppressed.

When the voltage of parasitic capacity of counterflow preventive diode D3 is charged up to Vsus/2, the protective diode D5 is in forward bias and conducts, and a loop channel is formed in the sequence of recovery inductor L1 to parasitic inductor L4 to recovery switch Q3 to parasitic inductor L3 to protective diode D5 to sustain switch Q1 to recovery inductor L1. Inverting this loop channel, the resonance current iL returns, and the energy accumulated in inductors L1, L3, L4 is consumed in the loop channel. As a result, the change (di/dt) of current iLP flowing in parasitic inductors L3, L4 is smaller than in the prior art (see broken line region B in FIG. 7), and thereby generation of surge voltage is suppressed.

<Mode 3>: Period from T3 to T4

Voltage V_Cp of PDP 10 is Vsus, and the sustain switch Q1 is on, and is turned off at the timing T3, and the recovery switch Q4 is turned on. From capacitive load Cp of PDP 10, an electric charge is regenerated in recovery capacitor Cr by way of recovery inductor L2 to parasitic inductor L5 to recovery switch Q4 to parasitic inductor L6 to counterflow preventive diode D4. The resonance current iL flowing at this time is inverted at a certain peak, and is inverted again to become zero, and mode 3 is terminated at this timing (T4).

In this period, the voltage across terminals V_D105 of the conventional protective diode D105 is applied up to Vsus as shown in FIG. 8 (*a*), whereas the voltage across terminals V_D5 of the protective diode D5 of the embodiment is applied only to Vsus/2 as shown in FIG. 8 (*b*). This is because the connection point of the conventional protective diode D105 is the terminal of recovery inductor L1, whereas the connection point of the protective diode D5 of the invention is connected to the connection point of recovery switch Q3 and counterflow preventive diode D3.

That is, in this mode, the connection point potential of recovery inductor L1 and protective diode D105 in the prior art is Vsus, but the connection point potential of protective diode D5 of the embodiment is Vsus/2, lower by the portion of Vsus/2 of the voltage across terminals of recovery switch D3 than Vsus.

Therefore, the withstand voltage of the protective diode D5 can be reduced to half of the conventional protective diode D105. It is hence possible to use a protective diode element having a lower forward voltage drop Vf, and heat loss occurring in protective diode can be reduced. Besides, the cost of the protective diode element is lowered. When a plurality of diodes are connected in parallel, since the number of pieces of parallel connection can be decreased, and the substrate mounting area is smaller, the manufacturing cost can be reduced.

<Mode 4>: Period from T4 to Next T1

Voltage V_Cp of PDP 10 is discharged nearly to zero (GOD potential), and the sustain switch Q2 is off, and is turned on at the timing T4. At this timing, voltage V_Cp of PDP 10 is fixed at zero (GND potential), but resonance current iL inverted at point T4 charges the parasitic capacity (not shown) of the counterflow preventive diode D4, and turns off the counterflow preventive diode D4.

At this time, as shown in broken line region A in FIG. 8, in the terminal voltage waveform V_D4 of the conventional counterflow preventive diode D4, a surge voltage is generated, but in the terminal voltage waveform V_D4 of the counterflow preventive diode D4 of the embodiment, a surge voltage is suppressed.

The reason is as follows: when the voltage of parasitic capacity of counterflow preventive diode D4 is charged up to Vsus/2, the protective diode D6 is in forward bias, and a loop channel is formed in the sequence of recovery inductor L2 to sustain switch Q2 to protective diode D6 to parasitic inductor L6 to recovery switch Q4 to parasitic inductor L5 to recovery inductor L2. Inverting this loop channel, the resonance current iL returns, and the energy accumulated in inductors L2, L5, L6 is consumed in the loop channel. As a result, the change (di/dt) of current iLP flowing in parasitic inductors L6, L5 is smaller than in the prior art (see broken line region B in FIG. 8), and thereby generation of surge voltage is suppressed.

In the embodiment, as described herein, the withstand voltage of protective diodes D5, D6 of the PDP driving circuit can be reduced to half. Further, since the surge voltage of the counterflow preventive diodes D3, D4 can be suppressed, the withstand voltage may be much lower than in the prior art.

In the above explanation, the recovery capacitor Cr is assumed to be charged to about Vsus/2, but it is possible to charge by other method, for example, a method of establishing a circuit and a period for charging the recovery capacitor Cr, in a period before start of recovery operation.

Besides, if any extra charging circuit is not provided, when charging by the regenerative power from the PDP 10, the recovery capacitor Cr can be changed up to Vsus/2 by starting recovery operation while gradually elevating the Vsus voltage (for example, elevating gradually from about Vsus/2).

The reason why the start mode is necessary is as follows: the withstand voltage of protective diode depends on the differential portion of Vsus of supply voltage and voltage across terminals of recovery switch, and usually withstand voltage of Vsus/2 is enough, but when the supply voltage is Vsus or when the voltage across terminals of recovery switch is nearly zero, the withstand voltage decreasing effect of protective diode is not obtained. In other words, the starting method is not particularly specified as far as the start mode is controlled so that the difference of supply voltage and voltage across terminals of recovery switch may be Vsus/2 or less.

The start mode of the embodiment is more specifically described below.

Figure 9:
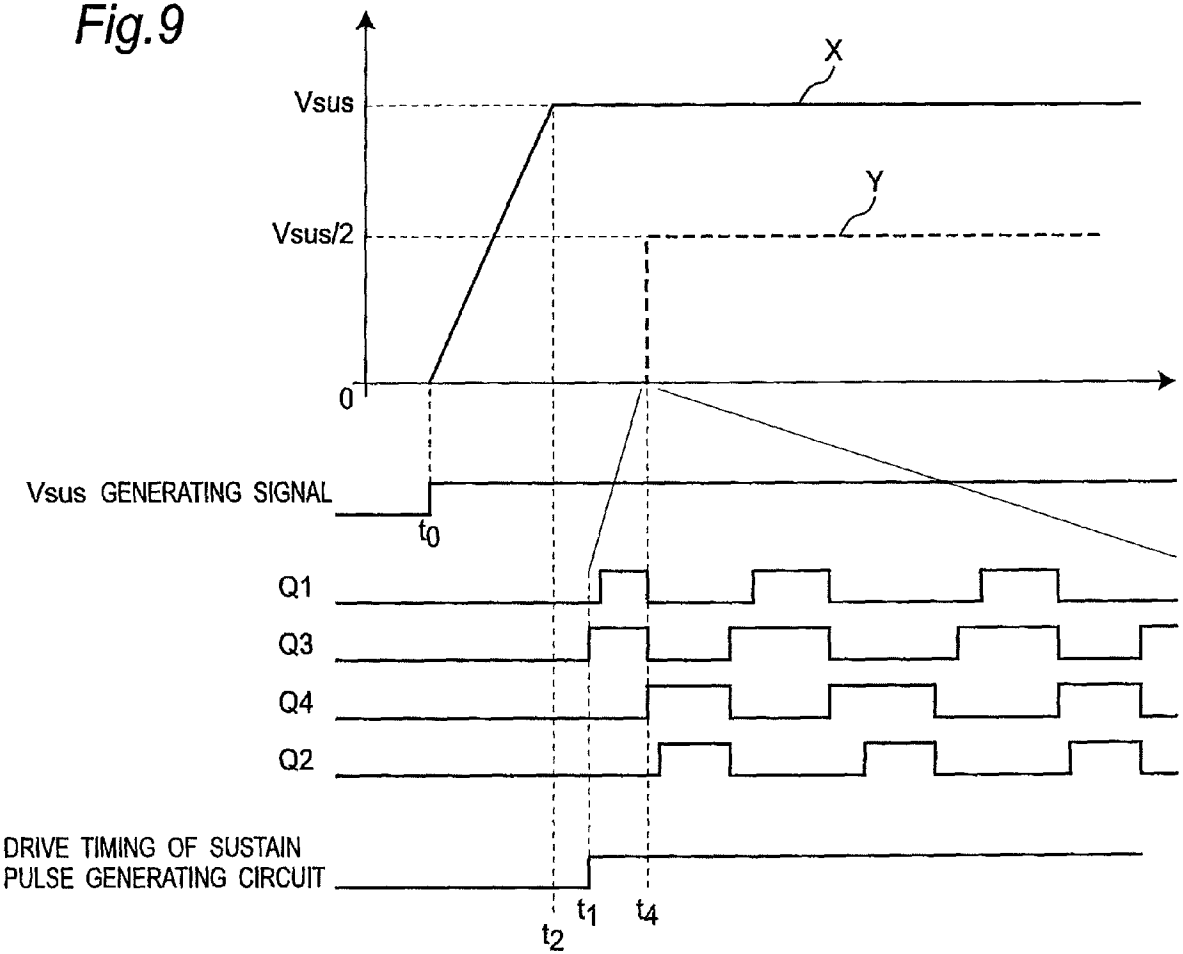
FIG. 9 is a diagram showing the relation of timing of control signal upon start and voltage of constant voltage power source V1 in a prior art.

First, the conventional start mode is explained. FIG. 9 is a diagram explaining the relation of control signal timing and voltage of constant voltage power source V1 upon start of PDP driving circuit. In the diagram, solid line X denotes the output voltage of constant voltage power source V1 and solid line Y represents the voltage of recovery capacitor Cr.

As shown in FIG. 9, the output of constant voltage power source V1 gradually climbs up after start and reaches specified voltage (Vsus). In the prior art, a drive signal of sustain pulse generating circuit was applied at a later timing (t1) than the timing (t2) of the output of constant voltage power source V1 reaching the specified voltage (Vsus). In initial state, the voltage of recovery capacitor Cr is zero, but by the subsequent on/off operation of switching elements Q1 to Q4, the recovery capacitor Cr is charged to Vsus/2. At this time, from the moment of output of constant power source V1 reaching specified voltage (Vsus) (t2), till the moment of voltage of recovery capacitor Cr reaching Vsus/2 (t4), voltage Vsus is applied between both ends of protective diode. This causes a problem in that withstand voltage of protective diode cannot be lowered.

This problem can be solved by the following starting operation.

Figure 10:
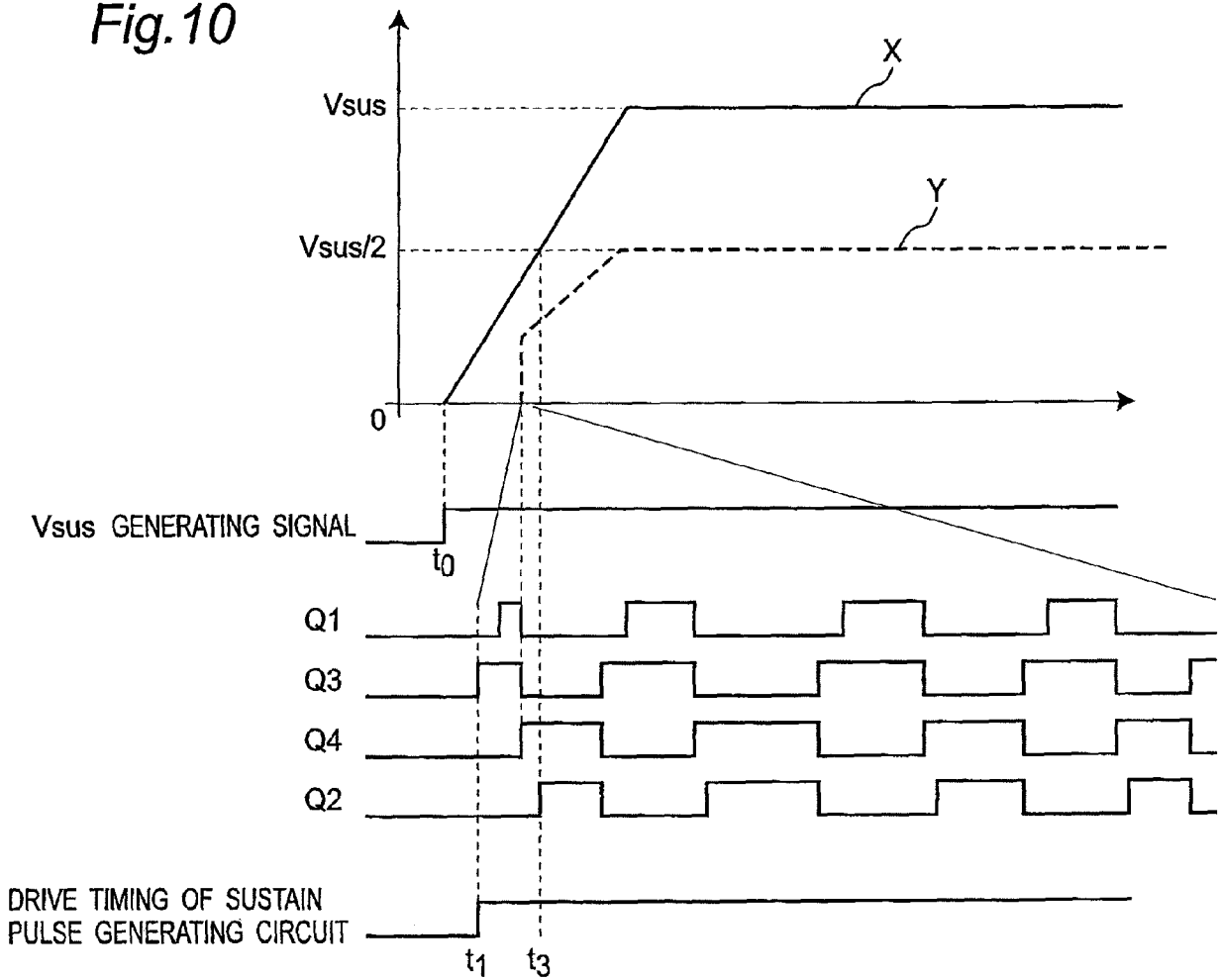
FIG. 10 is a diagram showing the relation of timing of control signal upon start and voltage of constant voltage power source V1 in an embodiment.

FIG. 10 is a diagram explaining the relation of control signal timing and voltage of constant voltage power source V1 upon start of PDP driving circuit of the embodiment.

As stated above, when the PDP driving circuit is started (the power is turned on), the output of constant voltage power source V1 climbs up gradually and reaches specified voltage (Vsus). At this time, in the embodiment, before the output of constant voltage power source V1 reaches Vsus/2, that is, at timing (t1) before the output of constant voltage power source V1 reaches Vsus/2 (t3), driving signal of sustain pulse generating circuit 5101 is applied.

When the driving signal of sustain pulse generating circuit 5101 is applied, the switching elements Q1 to Q4 start on/off operation at specified timing.

In initial state, since the voltage of recovery capacitor Cr is zero, if the switching element Q3 is turned on, the capacitive load Cp of PDP 10 will not be charged. At the turn-on timing of switching element Q1, a potential equal to the voltage of constant voltage power source V1 is supplied to the capacity load Cp. Then, after turning off the switching elements Q1, Q2, the switching element Q4 is turned on. At this time, the voltage accumulated in the capacitive load Cp of PDP 10 is regenerated into the recovery capacitor Cr. This regenerative voltage is determined by the ratio of capacity of capacitive load Cp of PDP and capacity of recovery capacitor Cp. Generally, the capacity of recovery capacitor Cr is about 10 to 30 times of capacity of PDP, and by repeating the turn-on operation of switching element Q4 by 10 to 30 times, about half voltage (Vsus/2) of voltage of constant voltage power source V1 can be accumulated in the recovery capacitor Cr.

The rise time of constant voltage power source V1 depends on the output power capacity of power source circuit and capacity of electrolytic capacitor connected to the constant voltage power source V1, but generally 500 msec to 1 sec or more is needed. By contrast, the turn-on period of switching element Q4 is about 5 μsec, and if this recovery operation is repeated 30 times, charging operation of recovery capacitor Cr is completed only in about 200 μsec, and about half voltage (Vsus/2) of constant voltage power source V1 can be charged in the recovery capacitor Cr.

By this starting operation, before the output of the constant voltage power source V1 reaches the voltage Vsus, the voltage of recovery capacitor Cr reaches Vsus/2. Hence voltage larger than Vsus/2 is not applied between both ends of protective diode. That is, as the difference of voltage of constant voltage power source V1 and voltage of recovery capacitor Cr is always held below Vsus/2 whether upon start or in stationary operation, the withstand voltage of protective diode can be lowered.

1.3 Modified Examples

Figure 11:
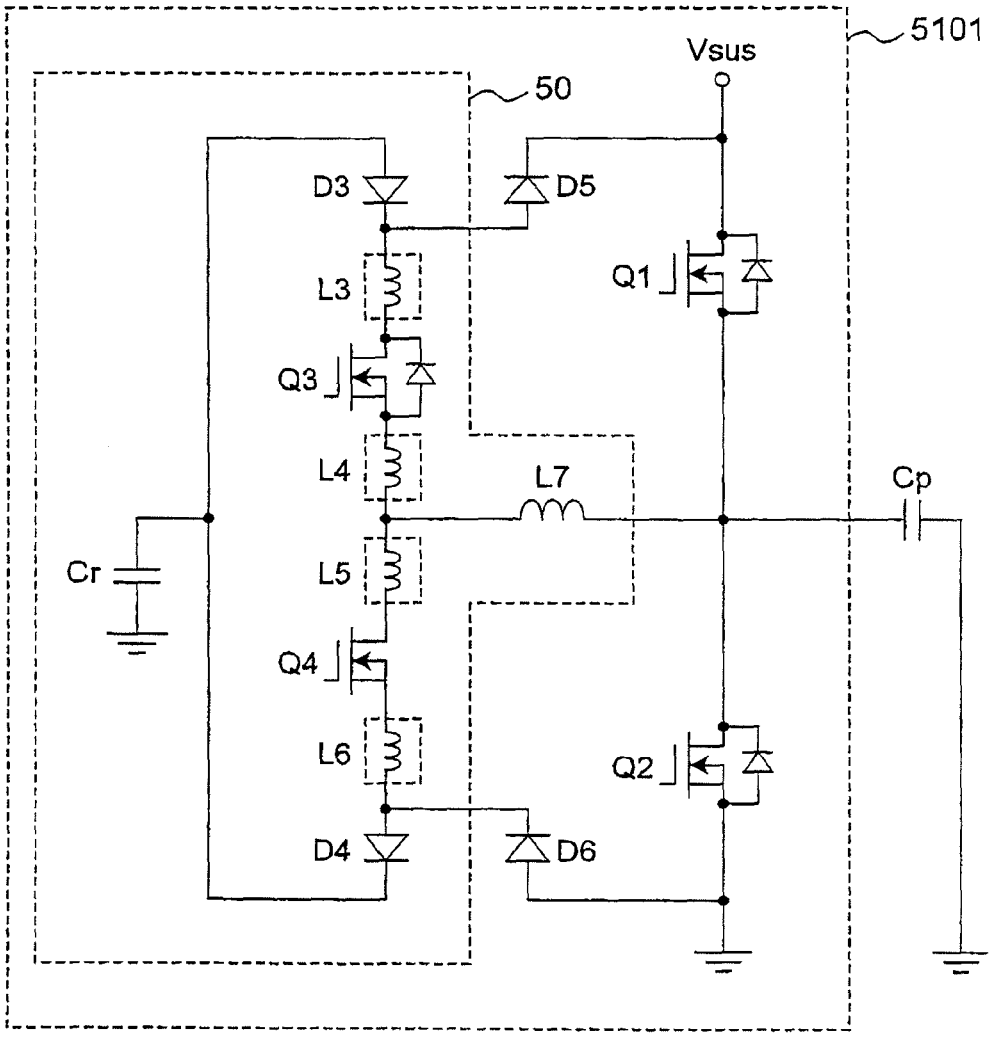
FIG. 11 is a diagram showing other example of configuration of power recovery circuit.

Other example of power recovery circuit is shown in shown in FIG. 11. In the power recovery circuit 50 shown in FIG. 11, the recovery inductances L1 and L2 shown in FIG. 1 are formed by one recovery inductance L7. This configuration is possible only in the condition that the period of mode 1 and period of mode 3 are identical. In the power recovery circuit 50 shown in FIG. 1, supposing the resonance current iL flowing in recovery conductor L1 or L2 to be corresponding to resonance current flowing in recovery inductance L7 in power recovery circuit 55, the operation can be explained same as in the power recovery circuit 50 shown in FIG. 1.

In this configuration, too, same as in FIG. 1, parasitic inductances L3 to L6 are present in the wiring of power recovery circuit 50, and the halving effect of withstand voltage of protective diodes D5, D6 and suppressing effect of surge voltage of counterflow preventive diodes D3, D4 can be obtained.

Switching elements Q1, Q2, Q3, Q4 may be generally known elements for making switching action such as MOSFET. In this case, body diodes are generated in reverse parallel to the switching action portions, and if the switching action is in cut-off state, a forward current for body diodes can be passed. Switching elements Q1, Q2, Q3, Q4 may be also composed of generally known insulating gate type bipolar transistors (IGBTs) having features of low loss and easy control in high voltage operation. It is considered that a large current of hundreds of amperes flows when driving the PDP 10. Since parasitic diodes are not generated in the IGBT, if the switching elements Q1 and Q2 are IGBTs, diodes corresponding to body diodes parasitically generated in the MOSFET are connected in reverse parallel to the switching elements Q1, Q2.

In the embodiment, types of switching elements are not particularly limited, and the switching elements Q1, Q2 may be composed of IGBTs, and switching elements Q3, Q4 may be composed of MOSFETs, or may be composed of other generally known elements making switching action.

Figure 12:
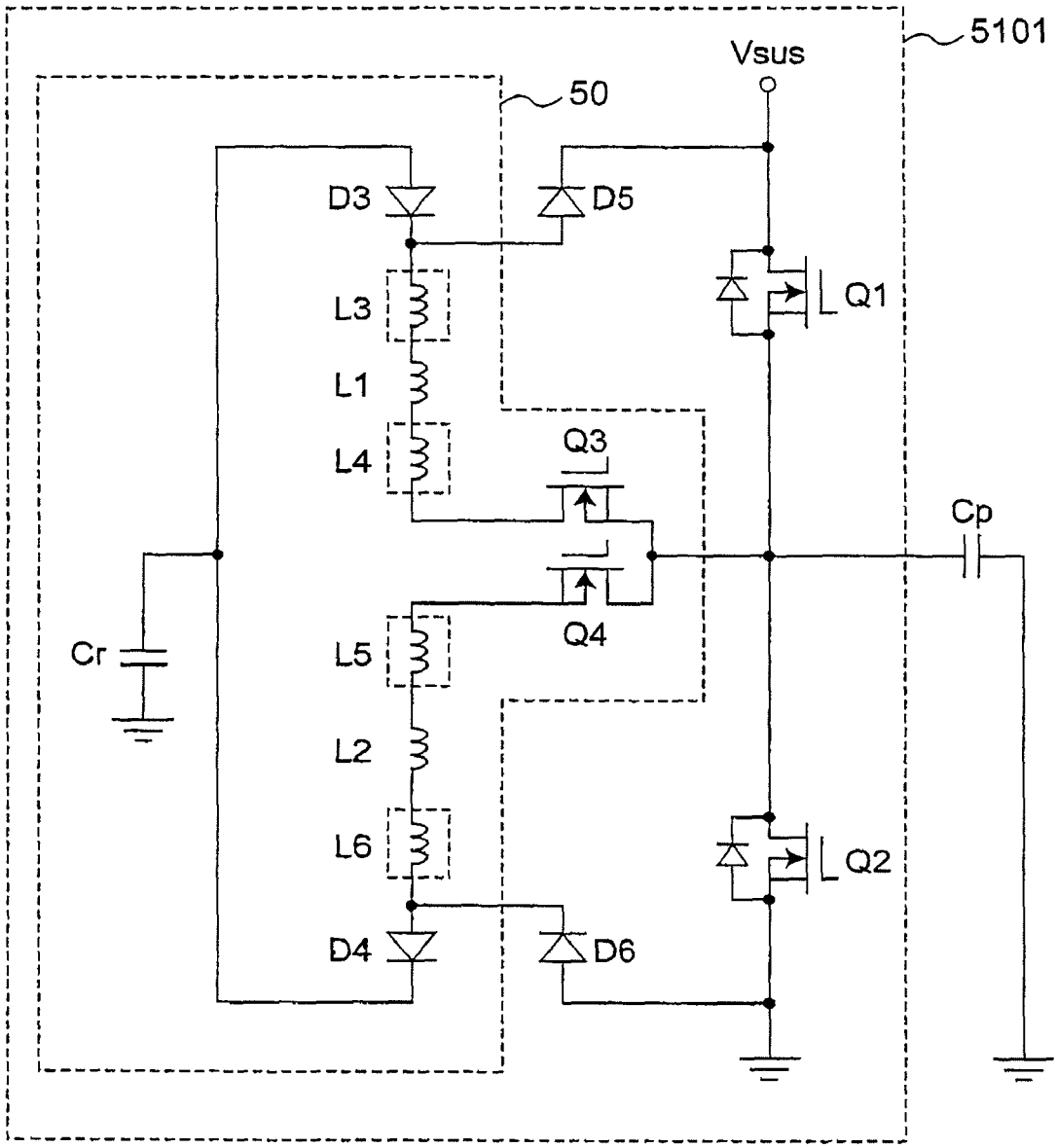
FIG. 12 is a diagram showing another example of configuration of power recovery circuit.

In the power recovery circuit 50 shown in FIG. 1, the position of recovery inductors L1, L2 may be replaced by the position of recovery switches Q3, Q4 (see FIG. 12). In this case, the anode of protective diode D5 is connected to the connection point of counterflow preventive diode D3 and recovery inductor L1, and the cathode of protective diode D6 is connected to the connection point of counterflow preventive diode D4 and recovery inductor L2.

1.4 Summary

According to the embodiment, in the power recovery circuit of sustain pulse generating circuit 5101, by connecting the protective diode between the recovery switch and counterflow preventive diode, the withstand voltage of protective diode can be reduced to half. Therefore, loss of protective diode can be decreased, and the number of elements connected in parallel can be reduced. Moreover, since the withstand voltage of counterflow preventive diode can be reduced, and Vf of counterflow preventive diode can be decreased, adn the recovery rate of electric power accumulated in the capacitive load of PDP 10 is improved, and the power consumption can saved.

2. Plasma Display Apparatus

Figure 13:
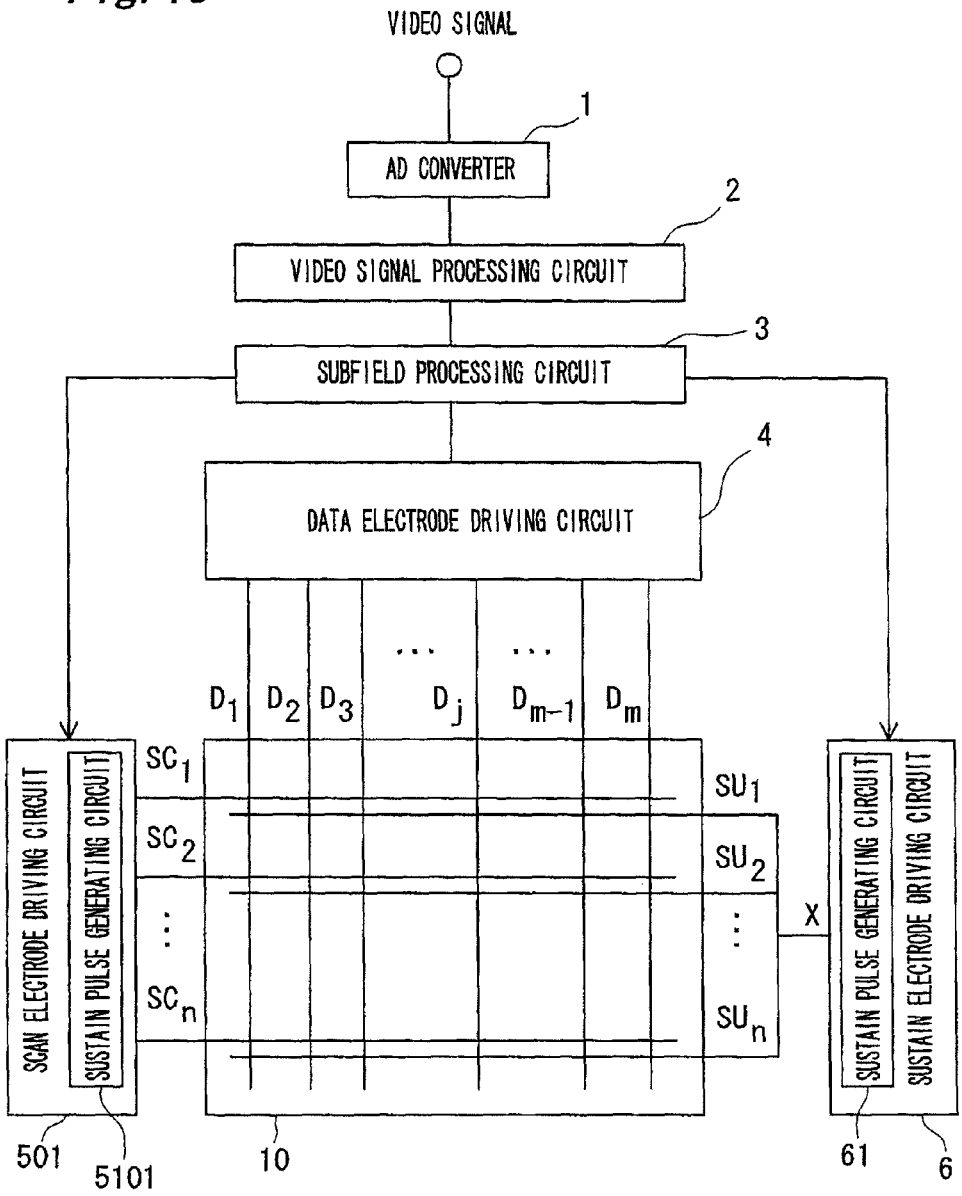
FIG. 13 is a block diagram of configuration of plasma display apparatus incorporating a PDP driving circuit in an embodiment.
Figure 14:
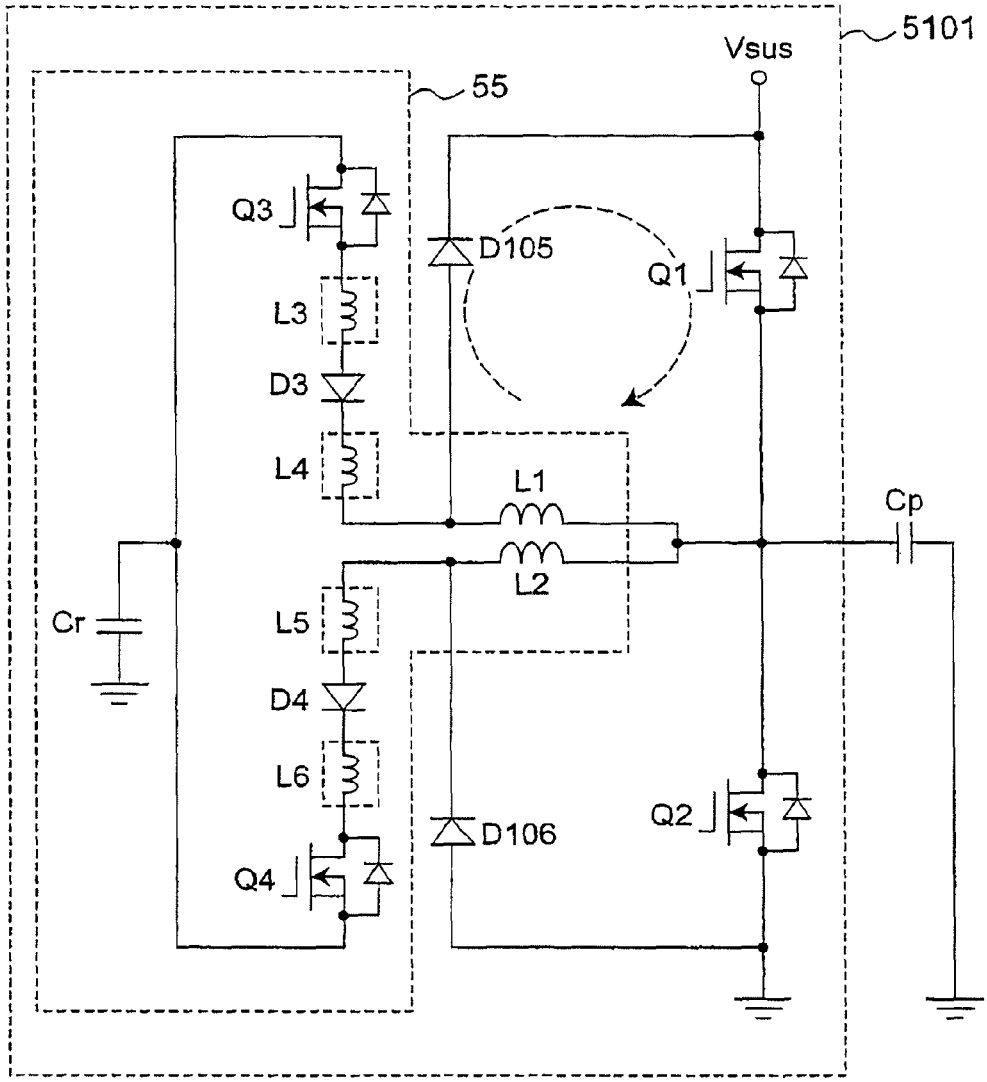
FIG. 14 is a block diagram of configuration of a PDP driving circuit in a prior art.

FIG. 13 is a block diagram of configuration of plasma display apparatus incorporating the PDP driving circuit of the embodiment.

The plasma display apparatus shown in FIG. 13 includes AD converter 1, video signal processing circuit 2, subfield processing circuit 3, data electrode driving circuit 4, scan electrode driving circuit 5, sustain electrode driving circuit 6, and PDP 10.

The AD converter 1 converts an input analog video signal into a digital video signal. The video signal processing circuit 2 converts from video signal of one field into subfield data for controlling each subfield, in order to emit light and display in the PDP 10 by combination of plural subfields different in weight in light emission period from the input digital video signal.

The subfield processing circuit 3 generates control signal for data electrode driving circuit, control signal for scan electrode driving circuit, and control signal for sustain electrode driving circuit, from the subfield data generated in the video signal processing circuit 2, and issues respectively to the data electrode driving circuit 4, scan electrode driving circuit 5, and sustain electrode driving circuit 6.

The PDP 10, as described above, is composed of n rows of scan electrodes SC1 to SCn (scan electrodes 22 in FIG. 2) and n rows of sustain electrodes SU1 to SUn (sustain electrodes 23 in FIG. 2) arrayed alternately in the row direction, and m columns of data electrodes D1 to Dm (data electrodes 32 in FIG. 2) arrayed in the column direction. Discharge cells Ci,j including a pair of scan electrode SCi and sustain electrode SUi (i=1 to n) and one data electrode Dj (j=1 to m) are formed by (m×n) pieces in discharge space, and one pixel is composed of three discharge cells emitting light in red, green and blue colors.

The data electrode driving circuit 4 drives data electrodes Dj independently on the basis of the control signal for data electrode driving circuit.

The scan electrode driving circuit 501 incorporates a sustain pulse generating circuit 5101 for generating sustain pulses to be applied to scan electrodes SC1 to SCn in sustain period, and can independently drive the scan electrodes SC1 to SCn. The scan electrode driving circuit 501 independently drives the scan electrodes SC1 to SCn on the basis of the control signal for driving the scan electrodes.

The sustain electrode driving circuit 6 incorporates a sustain pulse generating circuit 61 for generating sustain pulses to sustain electrodes SU1 to SUn in sustain period, and can drive all of sustain electrodes SU1 to SUn in the PDP 10 in batch. The sustain electrode driving circuit 6 drives the sustain electrodes SU1 to SUn on the basis of control signal for driving the sustain electrodes.

INDUSTRIAL APPLICABILITY

The invention relates to PDP driving circuit having power recovery circuit and plasma display apparatus, and is particularly useful for PDP driving circuit and plasma display apparatus capable of reducing withstand voltage of diode elements in recovery circuit.

What is claimed is:

1. A plasma display panel driving circuit that drives a plasma display panel which is a capacitive load, comprising:

a pulse generating unit that generates a specified pulse voltage applied to the capacitive load; and a power recovery unit that recovers an electric power from the capacitive load by a resonance operation with the capacitive load, and supplies the recovered power to the capacitive load, wherein the power recovery unit includes:

a recovery capacitor that has a capacity that is larger than a capacity of the capacitive load, and accumulates the recovered power;

a recovery inductor that resonates with the capacitive load;

a recovery switch element that connects the recovery capacitor to the capacitive load and a recovery inductor, and forms a channel that passes a current accompanied by a resonant operation of the capacitive load and the recovery inductor;

a counterflow preventive diode that blocks a flow of current in the recovery switch element in a reverse polarity direction; and a protective diode that forms a closed current channel including the recovery inductor, the recovery switch element, and the protective diode when the counterflow preventive diode is changed from an ON state to an OFF state, wherein an anode of the protective diode is connected to a connection point of the counterflow preventive diode and the recovery switch, and a cathode of the protective diode is connected to a power source for providing a specified voltage to be applied to sustain electrodes of the plasma display panel.

2. The plasma display panel driving circuit of claim 1, wherein the pulse generating unit starts driving, when starting up the plasma display panel driving circuit, before an output voltage of the power source that applies the specified voltage in a sustain period to the plasma display panel reaches ½ of the specified voltage.

3. A plasma display apparatus comprising:

the plasma display panel, the plasma display panel having a plurality of scan electrodes and sustain electrodes; and the plasma display panel driving circuit of claim 1 that drives the plasma display panel.

4. The plasma display apparatus of claim 3, wherein the pulse generating unit starts driving, when starting up the plasma display panel driving circuit, before an output voltage of the power source that applies the specified voltage in a sustain period to the plasma display panel reaches ½ of the specified voltage.

5. The plasma display panel driving circuit of claim 1, further comprising:

a second recovery inductor for resonating with the capacitive load;

a second recovery switch element for connecting the second recovery capacitor to the capacitive load and the second recovery inductor, and forming a channel for passing the current accompanied by resonant operation of capacitive load and the second recovery inductor;

a second counterflow preventive diode for blocking flow of a current in the second recovery switch element in reverse polarity direction; and a second protective diode for forming a closed current channel including the second recovery inductor, the second recovery switch element, and the second protective diode when the second counterflow preventive diode is changed from ON state to OFF state, wherein the second recovery switch element turns off during the specified pulse voltage is applied in a sustain period, the second counterflow preventive diode allows a current to flow to the recovery capacitor from the capacitive load, and a cathode of the second protective diode is connected to a connection point of the second counterflow preventive diode and the second recovery switch, and an anode of the second protective diode is connected to a ground potential.

6. The plasma display panel driving circuit of claim 1, wherein the pulse generating unit starts driving, when starting up the plasma display panel driving circuit, before an output voltage of the power source that applies the specified voltage in a sustain period to the plasma display panel reaches ½ of the specified voltage.

7. The plasma display panel driving circuit of claim 1, wherein the recovery switch element turns on when the specified pulse voltage is applied during a sustain period, and the counterflow preventive diode allows a current to flow from the recovery capacitor to the capacitative load.

8. A plasma display panel driving circuit that drives a plasma display panel which is a capacitive load, comprising:

a pulse generating unit that generates a specified pulse voltage applied to the capacitive load; and a power recovery unit that recovers an electric power from the capacitive load by a resonance operation with the capacitive load, and supplies the recovered power to the capacitive load, wherein the power recovery unit includes:

a recovery capacitor that has a capacity that is larger than a capacity of the capacitive load, and accumulates the recovered power, a recovery inductor that resonates with the capacitive load, a recovery switch element that connects the recovery capacitor to the capacitive load and a recovery inductor, and forms a channel that passes a current accompanied by a resonant operation of the capacitive load and the recovery inductor, a counterflow preventive diode that blocks a flow of current in the recovery switch element in a reverse polarity direction, and a protective diode that forms a closed current channel including the recovery inductor, the recovery switch element, and the protective diode when the counterflow preventive diode is changed from ON state to OFF state, wherein an anode of the protective diode is connected to a connection point of the counterflow preventive diode and the recovery inductor, and a cathode of the protective diode is connected to a power source for providing a specified voltage to be applied to sustain electrodes of the plasma display panel.

9. The plasma display panel driving circuit of claim 8, further comprising:

a second recovery inductor for resonating with the capacitive load;

a second recovery switch element for connecting the second recovery capacitor to the capacitive load and the second recovery inductor, and forming a channel for passing the current accompanied by resonant operation of capacitive load and the second recovery inductor;

a second counterflow preventive diode for blocking flow of current in the second recovery switch element in reverse polarity direction; and a second protective diode for forming a closed current channel including the second recovery inductor, the second recovery switch element, and the second protective diode when the second counterflow preventive diode is changed from ON state to OFF state, wherein the second recovery switch element turns off during the specified pulse voltage is applied in a sustain period, the second recovery inductor is connected between the second recovery switch element and the second counterflow preventive diode, the second counterflow preventive diode allows a current to flow from the capacitive load to the recovery capacitor, and a cathode of the second protective diode is connected to a connection point of the second counterflow preventive diode and the second recovery inductor, and an anode of the second protective diode is connected to a ground potential.

10. The plasma display panel driving circuit of claim 8, wherein the recovery switch element turns on when the specified pulse voltage is applied during a sustain period, the recovery inductor is connected between the recovery switch element and the counterflow preventive diode, and the counterflow preventive diode allows a current to flow from the recovery capacitor to the capacitative load.

11. A plasma display panel driving circuit that drives a plasma display panel which is a capacitive load, comprising:

a pulse generator that generates a specified pulse voltage applied to the capacitive load; and a power recoverer that recovers an electric power from the capacitive load by a resonance operation with the capacitive load, and supplies the recovered power to the capacitive load, wherein the power recoverer includes:

a recovery capacitor that has a capacity that is larger than a capacity of the capacitive load, and accumulates the recovered power;

a recovery inductor that resonates with the capacitive load;

a recovery switcher that connects the recovery capacitor to the capacitive load and a recovery inductor, and forms a channel that passes a current accompanied by a resonant operation of the capacitive load and the recovery inductor;

a counterflow preventive diode that blocks a flow of current in the recovery switch element in a reverse polarity direction; and a protective diode that forms a closed current channel including the recovery inductor, the recovery switcher, and the protective diode when the counterflow preventive diode is changed from an ON state to an OFF state, wherein an anode of the protective diode is connected to a connection point of the counterflow preventive diode and the recovery switcher, and a cathode of the protective diode is connected to a power source for providing a specified voltage to be applied to sustain electrodes of the plasma display panel.

12. A plasma display apparatus comprising:

the plasma display panel, the plasma display panel having a plurality of scan electrodes and sustain electrodes; and the plasma display panel driving circuit of claim 11 that drives the plasma display panel having a plurality of scan electrodes and sustain electrodes.

13. The plasma display apparatus of claim 12, wherein the pulse generator starts driving, when starting up the plasma display panel driving circuit, before an output voltage of the power source that applies the specified voltage in a sustain period to the plasma display panel reaches ½ of the specified voltage.

14. The plasma display panel driving circuit of claim 11, wherein the recovery switcher turns on when the specified pulse voltage is applied during a sustain period, and the counterflow preventive diode allows a current to flow from the recovery capacitor to the capacitative load.

* * * * *